US007631909B2

(12) United States Patent
Snyder et al.

(10) Patent No.: US 7,631,909 B2
(45) Date of Patent: Dec. 15, 2009

(54) CROWNED STRIKER MOUNTING PLATE

(75) Inventors: Mark Snyder, Farmington Hills, MI (US); Sigmond Jamison, Farmington Hills, MI (US)

(73) Assignee: Nissan Technical Center North America, Inc., Farmington Hills, MI (US)

( * ) Notice: Subject to any disclaimer, the term of this patent is extended or adjusted under 35 U.S.C. 154(b) by 25 days.

(21) Appl. No.: 11/562,783

(22) Filed: Nov. 22, 2006

(65) Prior Publication Data

US 2008/0116700 A1 May 22, 2008

(51) Int. Cl.
*E05B 15/02* (2006.01)
*E05B 15/00* (2006.01)

(52) U.S. Cl. ..... 292/340; 292/341; 292/DIG. 42; 292/DIG. 65

(58) Field of Classification Search ..... 292/340, 292/341, DIG. 42, DIG. 65
See application file for complete search history.

(56) References Cited

U.S. PATENT DOCUMENTS 4,998,759 A * 3/1991 Peterson et al. ..... 292/340
5,295,720 A 3/1994 Budde
5,501,495 A 3/1996 Claucherty
5,716,085 A * 2/1998 Kobayashi ..... 292/340
6,616,204 B1 9/2003 Mitts et al.
6,692,046 B2 2/2004 Paskonis
7,097,219 B2 8/2006 Paskonis
7,140,652 B2 * 11/2006 Johnson et al. ..... 292/340
2007/0001468 A1 * 1/2007 Burton ..... 292/340

* cited by examiner

*Primary Examiner*—Carlos Lugo
(74) *Attorney, Agent, or Firm*—Young Basile

(57) ABSTRACT

A striker apparatus for mounting to a support structure of a vehicle and for engagement with a corresponding latching mechanism can include a striker, and a base plate for supporting the striker extending outwardly from a first surface. A second surface opposite from the first surface of the base plate can include at least one radius of curvature defining a generally concave profile on the second surface or through the entire base plate. The base plate includes sufficient flexure to be substantially positioned in mating contact with a support structure of the vehicle when attached by one or more fasteners.

35 Claims, 7 Drawing Sheets

CROWNED STRIKER MOUNTING PLATE

FIELD OF THE INVENTION

The present invention relates to a striker apparatus for a vehicle latching mechanism.

BACKGROUND

Various latching mechanisms for vehicles are known for example from U.S. Pat. No. 7,097,219; U.S. Pat. No. 6,692,046; U.S. Pat. No. 6,616,204; U.S. Pat. No. 5,501,495; and U.S. Pat. No. 5,295,720. However, each of these known configurations suffers from the inability to provide a reliable, secure mounting of a striker plate with respect to a non-uniform, potentially non-planar, mating surface. If a proper secure mounting of a striker to a corresponding mounting surface is not obtained during assembly, movement of the striker can allow over slam of the corresponding closure member. In addition, loose or improper mounting of a striker to a corresponding mating surface can result in undesirable fit and finish appearance issues, as well as other operational issues associated with proper alignment of the latch mechanism, including engagement and release issues of the latch mechanism with respect to the striker in the desired fashion.

SUMMARY

A striker apparatus for a vehicle latching mechanism can include a striker, and a base plate for supporting the striker extending outwardly from an outer surface of the base plate. An inner surface of the base plate, opposite from the outer surface, can include a radius of curvature defining a concave profile along the inner surface. The base plate can have sufficient flexure to be substantially flexed into a generally mating mounting surface shape when attached to a support structure of a vehicle. In other words, a crowned striker mounting plate according to an embodiment of the present invention can include an arcuate or concave base plate for a secure mounting of the striker to an intended mounting surface. The length, width, thickness and radius of curvature of the mounting plate can be of a value sufficient to allow the plate to flatten in response to fasteners being tightened while mounting the mounting plate to the supporting surface of the vehicle. In other words, installation bolt torque can be sufficiently large to eliminate a gap between the concave inner surface of the mounting plate and the support surface of the vehicle in order to provide a solid mounting across substantially an entire inner surface of the mounting plate. A slight curvature to the profile of a striker base plate is implemented to insure mating of the mounting plate of the striker to the support surface in a secure fashion. Secure, mating attachment of the mounting plate of the striker to the support surface helps reduce over slam of a closure member by maintaining the striker against movement with respect to the support surface.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
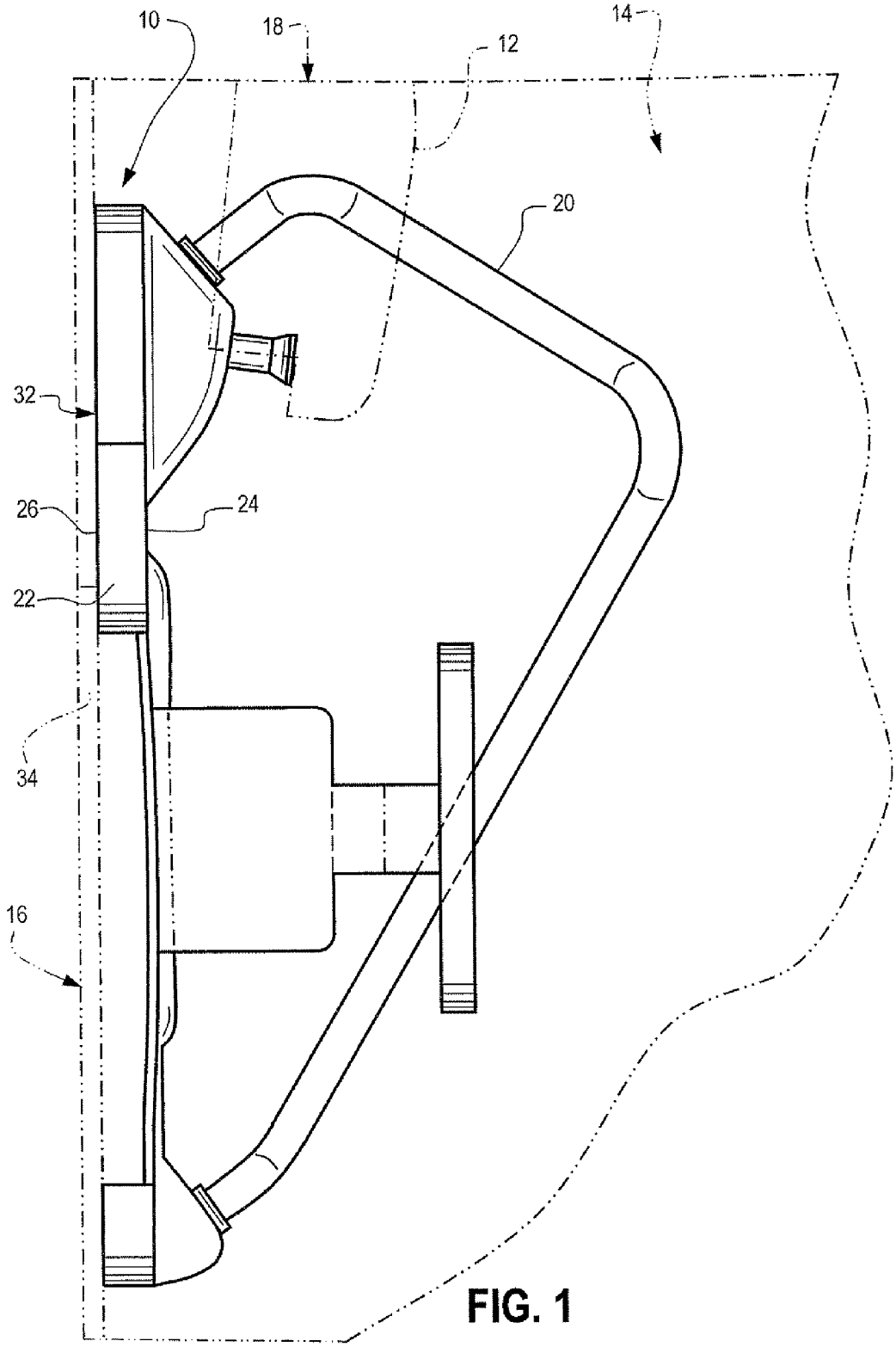
FIG. 1 is a side elevational view of a crowned striker mounting plate according to an embodiment of the present invention.
Figure 2:
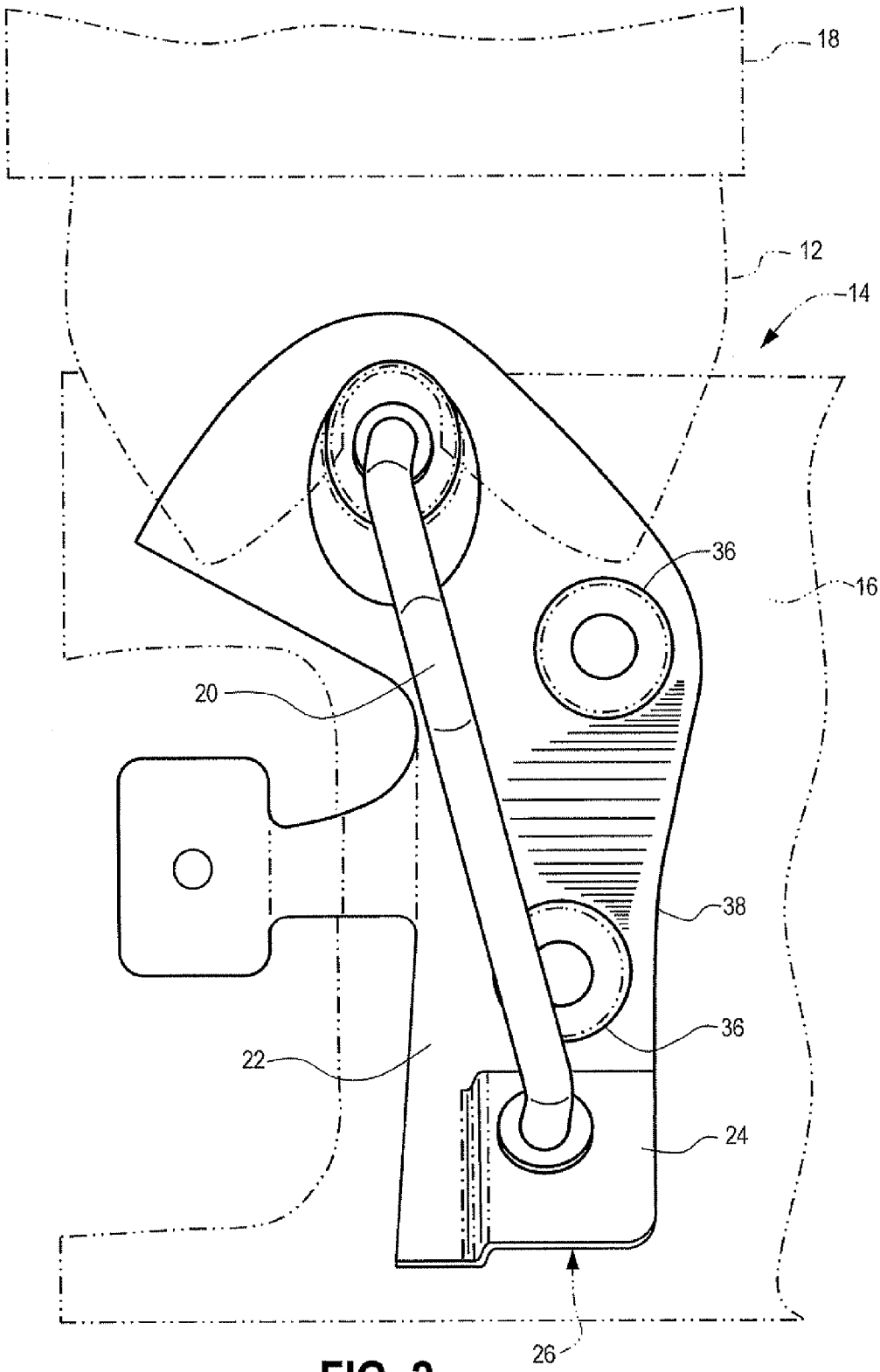
FIG. 2 is a front elevational view of the crowned striker mounting plate illustrated in FIG. 1.
Figure 4:
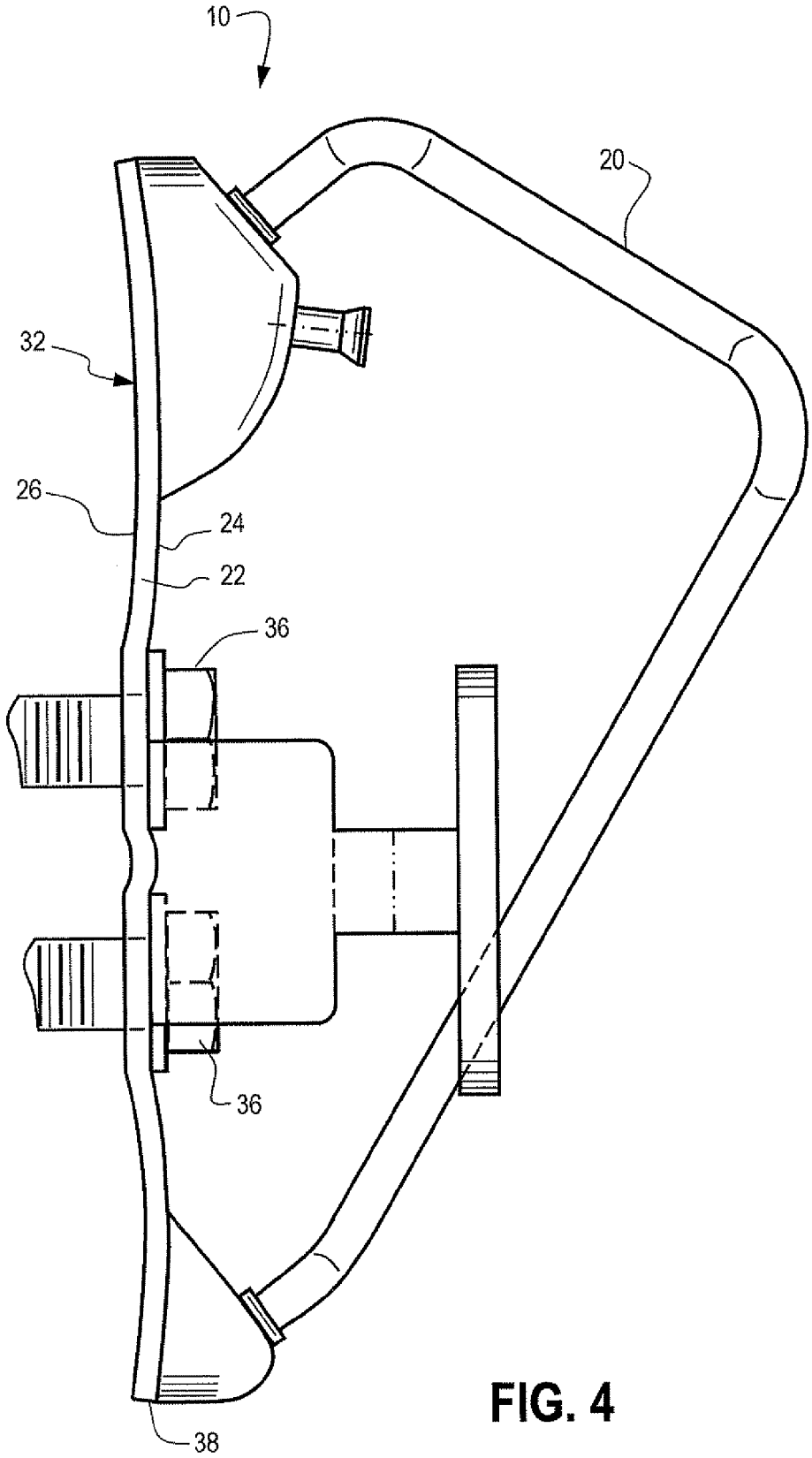
FIG. 4 is a simplified schematic view of the crowned striker mounting plate of FIG. 3 after installation on a support surface.
Figure 5:
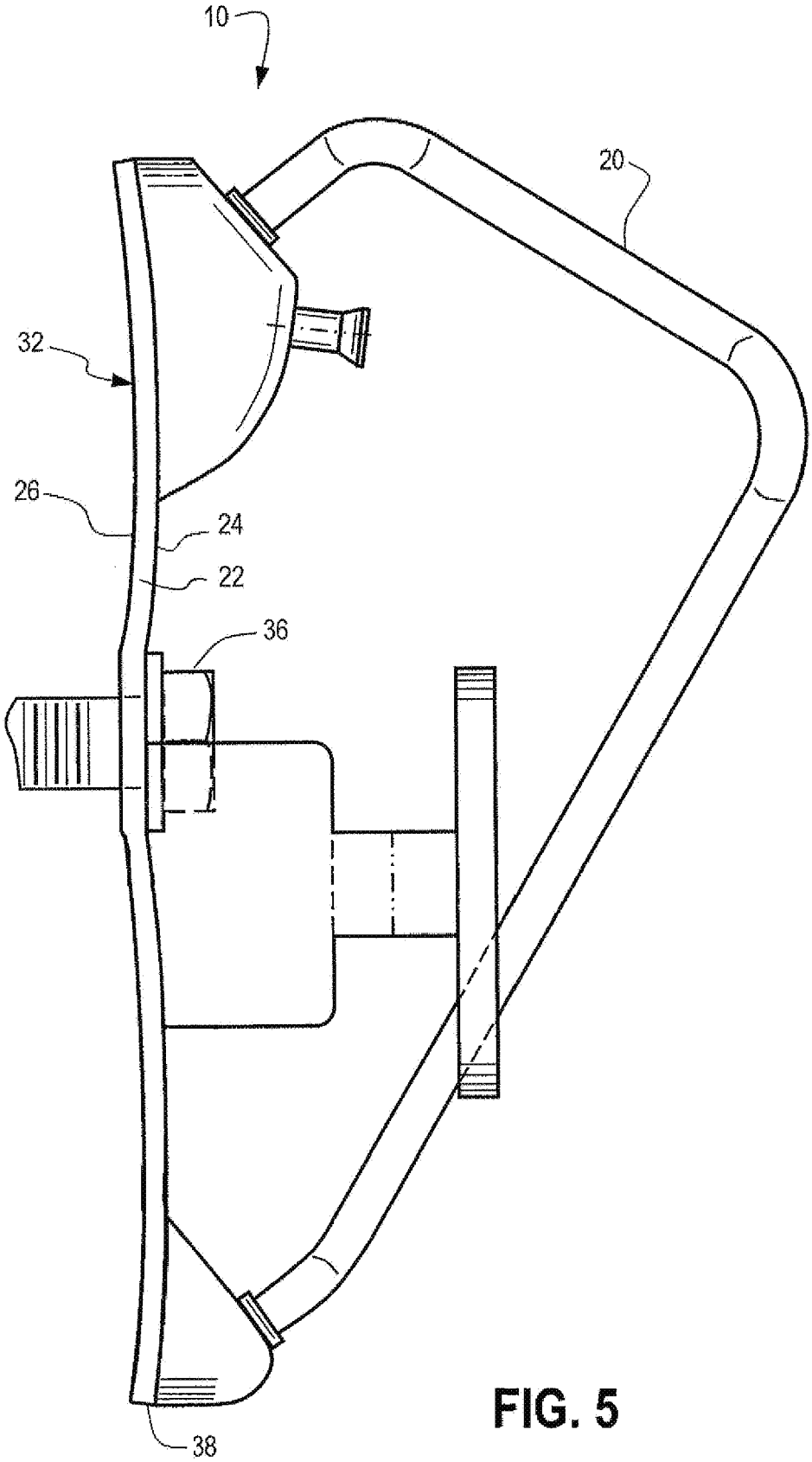
FIG. 5 is a simplified schematic view of the crowned striker mounting plate installed on a support surface using a single fastener.
Figure 6:
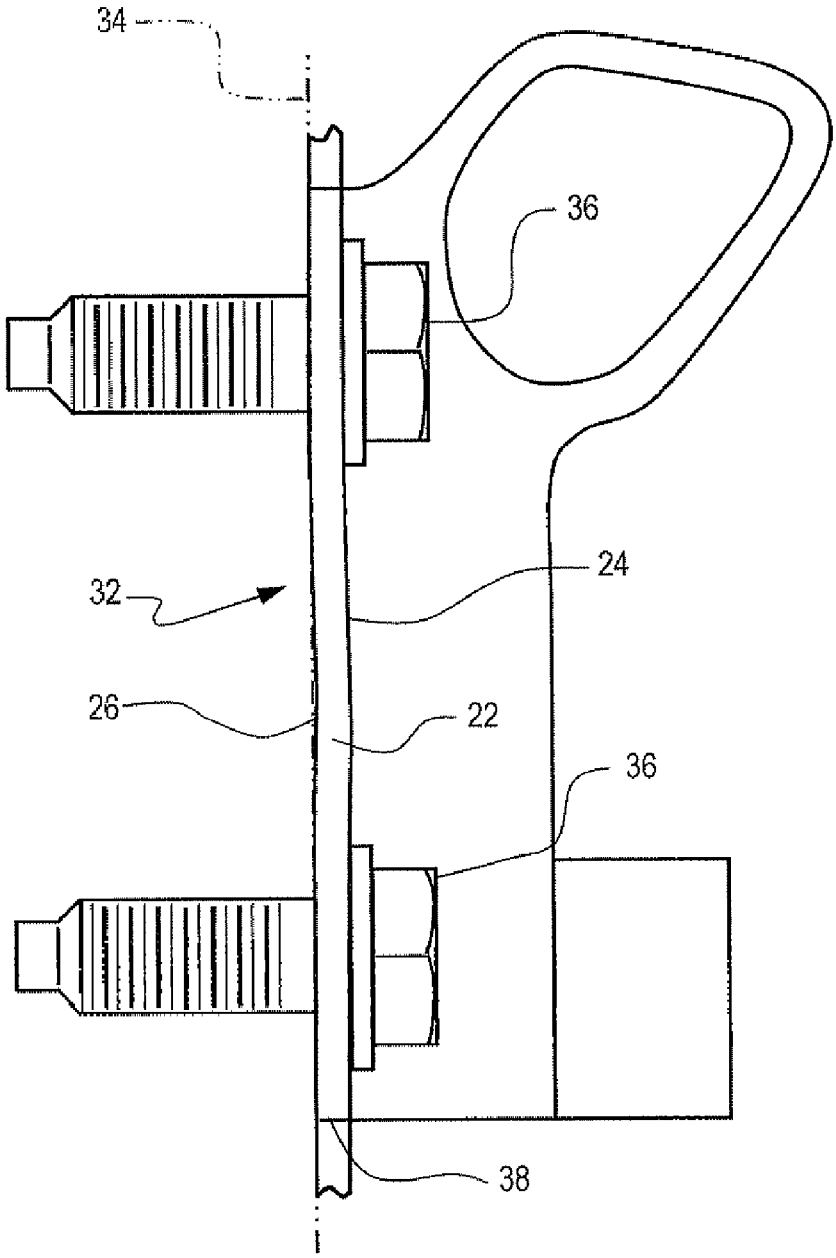
FIG. 6 is a simplified schematic diagram of a single piece, stamped metal, crowned striker mounting plate in an uninstalled position with respect to a support surface shown in phantom.
Figure 7:
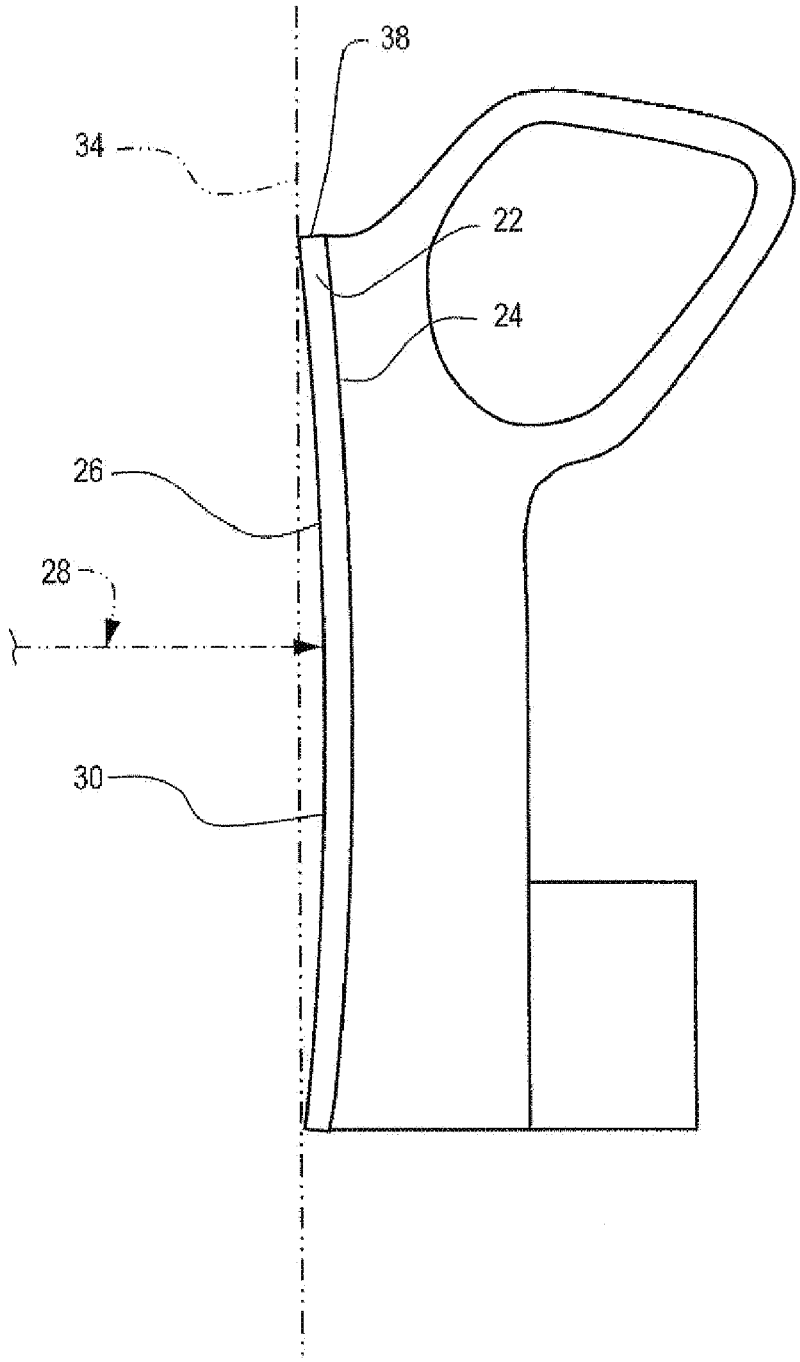
FIG. 7 is a simplified schematic view of the crowned striker mounting plate illustrated in FIG. 6 in an installed position with fasteners engaging and flattening the crowned striker, mounting plate against the support surface shown in phantom.

Referring now to FIGS. 1 and 2, a striker apparatus 10 for a vehicle latching mechanism 12 is illustrated by way of example and not limitation with respect to a trunk 14 of a vehicle 16 and corresponding trunk lid 18. It should be recognized that the striker apparatus 10 can be used in any vehicle latching mechanism location, for example hoods, doors, or the like, and is not limited to a vehicle trunk latching mechanism location as illustrated in FIGS. 1 and 2. The striker apparatus 10 according to an embodiment of the present invention can include a striker 20, and a base plate 22 supporting the striker 20 extending outwardly from an outer surface 24. The base plate 22 can include an inner surface 26 opposite from an outer surface 24. The base plate 22 can include a radius of curvature 28 (best seen in the schematic illustration of FIG. 3) defining a concave profile 30 on the inner surface 26. The base plate 22 has sufficient flexure to be substantially flexed into a generally mating mounting surface shape 32 (best seen in FIGS. 1, 4, and 7) when attached to a support structure 34 of the vehicle 16. The base plate 22 and striker 20 can be constructed by any suitable process, by way of example and not limitation, such as by assembly (as shown in FIGS. 1-5) or by stamping a single piece, metal part (as shown in FIGS. 6-7).

Figure 3:
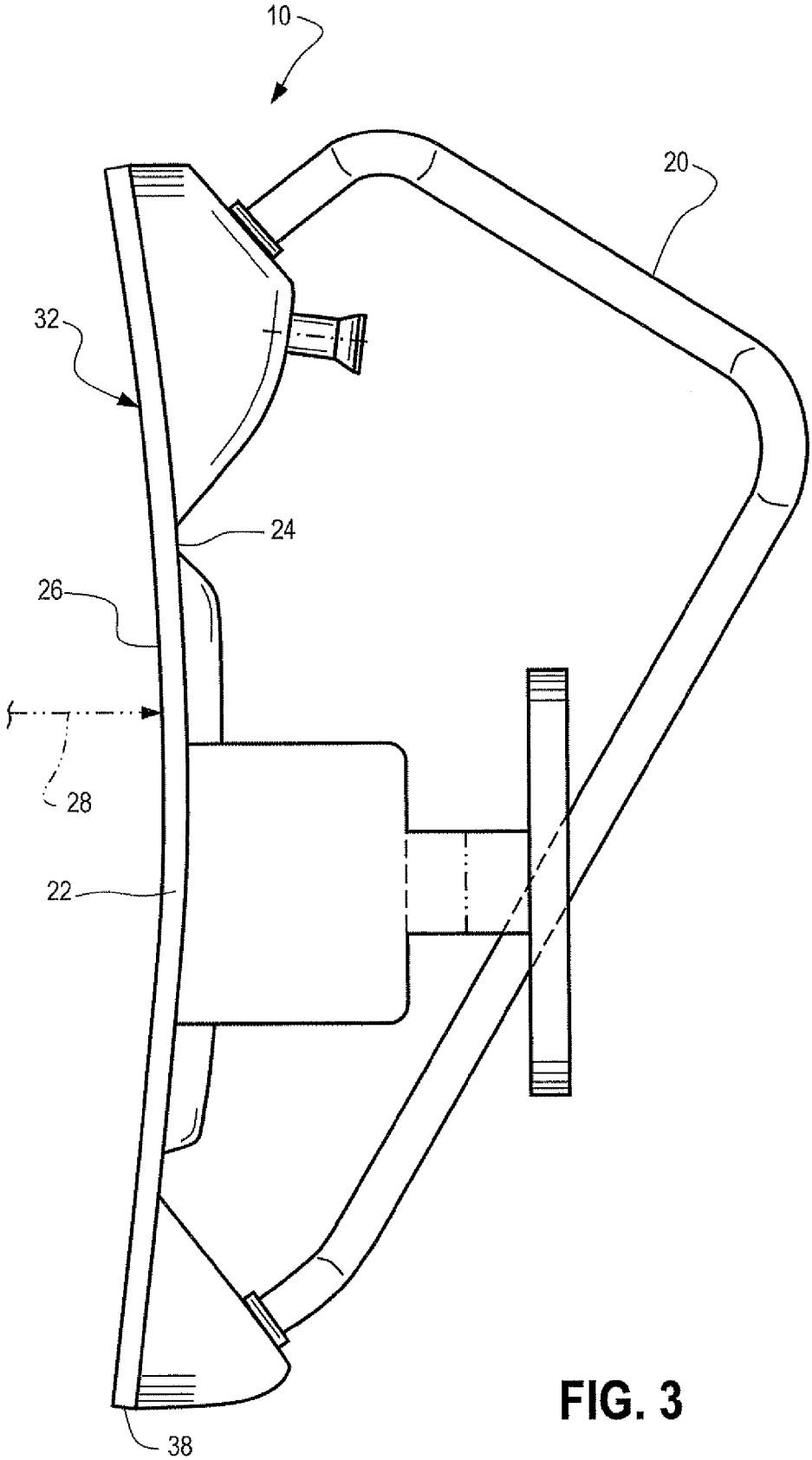
FIG. 3 is a simplified schematic view of the crowned striker mounting plate of FIG. 1 prior to installation on a support surface.

The radius of curvature 28 of the base plate 22 can define generally parallel inner and outer surfaces 26, 24 of the base plate 22 prior to attachment of the base plate 22 to the support structure 34 of the vehicle 16. At least one fastener 36 (best seen in FIGS. 2, 4-5 and 7) can be provided for attaching the base plate 22 and striker 20 to be installed with respect to the support structure 34 of the vehicle 16. As best seen in FIGS. 4-5, the at least one fastener 36 can be a threaded fastener. The radius of curvature 28 (as best seen in FIGS. 3 and 6) of the base plate 22 in cooperation with flexure of the base plate 22 as the at least one fastener 36 is tightened during installation allows the base plate 22 of the striker apparatus 10 to be securely mounted to a non-uniform, and/or non-consistent (i.e. large tolerance), and/or non-planar mounting surface of the support structure 34 shown in FIGS. 1-7 as phantom lines/surface 34.

The radius of curvature 28 of the base plate 22 in cooperation with flexure of the base plate 22 as the at least one fastener 36 is tightened during installation can improve fit and finish appearance of the installed striker apparatus 10 in the vehicle 16 by reducing gaps between the base plate 22 and the support structure 34 of the vehicle 16 around the periphery 38 of the base plate 22. The base plate 22 of the striker apparatus 10 can be formed with any desired peripheral configuration depending on the particular application environment in which the striker apparatus 10 is to be installed. Flexure of the base plate 22 as the at least one fastener 36 is tightened during installation to the support structure 34 of the vehicle 16 can improve stability and consumer satisfaction of the striker apparatus 10 by reducing vibration and noise generated between the base plate 22 and the support structure or mounting surface 34 of the vehicle 16.

A striker apparatus 10 according to an embodiment of the present invention can be provided for mounting to a support structure 34 of a trunk 14 of a vehicle 16 and for engagement with a latching mechanism 12 for holding a trunk lid 18 in a closed position in cooperation with the striker apparatus 10. The striker apparatus 10 can include a striker 20 for engagement with the latching mechanism 12, and a base plate 22 for supporting the striker 20 extending outwardly from an outer or first surface 24. The base plate 22 can include an inner or second surface 26 opposite from the first surface 24. The base plate 22 can have a radius of curvature 28 defining a generally concave, non-planar, profile 30 on the second surface 26. The base plate 22 has sufficient flexure to be substantially positioned in mating contact with a support surface 34 of the vehicle 16 when attached to the support surface 34 of the vehicle 16. The radius of curvature 28 can be any desired value provided the contour is sufficiently large to adapt for any variances in support structure 34 tolerances when flexed between the uninstalled state, and the installed state of the base plate 22. The addition of the radius of curvature 28 permits the acceptance of a greater variance in tolerances of the support structure 34. The curvature or contour 28 of the base plate 22 can be in the form of simple single radius 28, or can be provided with multiple radii of curvature in order to better adapt to a non-planar support structure 34 in a vehicle 16 if desired. In either case, the base plate 22 is provided with sufficient flexure to allow the base plate 22 to flex into mating contact with the planar or non-planar support structure 34 during installation of the striker apparatus 10. The flexure of the base plate 22 during installation improves fit and finish appearance of the installed striker in the vehicle by reducing gaps between the base plate 22 and the support structure 34 around a periphery of the base plate 22. The flexure of the base plate also improves stability and consumer satisfaction of the striker apparatus 10 by reducing vibration and noise generated between the base plate 22 and the support structure 34 of the vehicle 16.

While the invention has been described in connection with what is presently considered to be the most practical and preferred embodiments it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A striker apparatus for a vehicle latching mechanism, the striker apparatus comprising:

a striker;

a base plate supporting the striker extending outwardly from an outer surface and having an inner surface opposite from the outer surface, the base plate having a radius of curvature defining a concave profile on the inner surface, the base plate having sufficient flexure to be substantially flexed into a generally mating mounting surface shape when attached to a support structure of a vehicle;

at least one fastener for attaching the base plate and striker to be installed with respect to the support structure of the vehicle;

the base plate having a pre-installation position, wherein the base plate contacts the support structure of the vehicle at a first point and a second point and the base plate is spaced from the support structure along the concave profile; and the base plate having a post-installation position, wherein the base plate is in mating contact with the support structure of the vehicle at the first point and the second point, and the base plate engages the support structure in at least one point along the concave profile to define the generally mating mounting surface shape, the at least one point along the concave profile corresponding to the at least one fastener.

2. The striker apparatus of claim 1, wherein the radius of curvature defines generally parallel inner and outer surfaces of the base plate prior to attachment to the support structure of the vehicle.

3. The striker apparatus of claim 1, wherein the at least one fastener is a threaded fastener.

4. The striker apparatus of claim 1, wherein the radius of curvature of the base plate in cooperation with flexure of the base plate as the at least one fastener is tightened during installation allows the base plate of the striker to be securely mounted to a non-uniform, non-planar mounting surface.

5. The striker apparatus of claim 1, wherein the radius of curvature of the base plate in cooperation with flexure of the base plate as the at least one fastener is tightened during installation improves fit and finish appearance of the installed striker in the vehicle by reducing gaps between the base plate and the mounting structure of the vehicle around a periphery of the base plate.

6. The striker apparatus of claim 1, wherein the radius of curvature of the base plate in cooperation with flexure of the base plate as the at least one fastener is tightened during installation improves stability and consumer satisfaction of the striker by reducing vibration and noise generated between the base plate and the mounting structure of the vehicle.

7. The striker apparatus of claim 1, wherein the inner surface and the mounting surface are mated at least at the distal ends of the curve and a fastening point.

8. The striker apparatus of claim 1, wherein a first end of the striker attaches to a first end portion of the base plate, and a second end of the striker attaches to a second end portion of the base plate.

9. The striker apparatus of claim 8, wherein the at least one fastener is positioned between the first and second ends of the striker.

10. The striker apparatus of claim 8, wherein the curved surface extends between the first and second ends of the striker.

11. The striker apparatus of claim 1, wherein the base plate and striker are unitarily formed.

12. The striker apparatus of claim 1, wherein the first point, the second point and the at least one point along the concave profile are arranged along a line adjacent to a lateral edge of the base plate.

13. The striker apparatus of claim 1, wherein the at least one fastener engages the support structure to flex the base plate from the pre-installation position to the post installation position.

14. The striker apparatus of claim 13, wherein the generally mating mounting surface shape substantially conforms to the geometry of the support structure of the vehicle.

15. The striker apparatus of claim 1, wherein the striker includes at least one leg that is non-orthogonal with respect to the base.

16. The striker apparatus of claim 1, wherein the concave profile extends continuously throughout the inner surface of the base plate.

17. The striker apparatus of claim 1, wherein the at least one fastener extends through the base plate within the concave profile thereof.

18. The striker apparatus of claim 1, wherein the at least one fastener extends through the base plate at the at least one point along the concave profile to flex the base plate from the pre-installation position to the post-installation position.

19. The striker apparatus of claim 1, wherein the first point and the second point are both disposed proximate to the concave profile.

20. A striker apparatus for mounting to a support structure of a vehicle and for engagement with a latching mechanism, the striker apparatus comprising:

a striker for engagement with the latching mechanism;

a base plate supporting the striker extending outwardly from an outer surface and having an inner surface opposite from the outer surface, the base plate having a radius of curvature defining a concave profile on the inner surface, the base plate having sufficient flexure to be substantially conformed to a mounting surface shape when attached to a support structure of a vehicle;

at least one fastener for attaching the base plate and striker to be installed with respect to the support structure of the vehicle;

the base plate having a pre-installation position, wherein the base plate contacts the support structure of the vehicle at a first point disposed at a first end of the base plate and a second point disposed at a second end of the base plate and the base plate is spaced from the support structure along the concave profile;

and the base plate having a post-installation position, wherein the base plate is in mating contact with the support structure of the vehicle at the first point and the second point, and the base plate engages the support structure in at least one point along the concave profile to define the generally mating mounting surface shape, the number of points along the concave profile corresponding to the number of fasteners.

21. The striker apparatus of claim 20, wherein the radius of curvature defines generally parallel inner and outer surfaces of the base plate prior to attachment to the support structure of the vehicle.

22. The striker apparatus of claim 20, wherein the at least one fastener is a threaded fastener.

23. The striker apparatus of claim 20, wherein the radius of curvature of the base plate in cooperation with flexure of the base plate as the at least one fastener is tightened during installation allows the base plate of the striker to be securely mounted to a non-uniform, non-planar mounting surface.

24. The striker apparatus of claim 20, wherein the radius of curvature of the base plate in cooperation with flexure of the base plate as the at least one fastener is tightened during installation improves fit and finish appearance of the installed striker in the vehicle by reducing gaps between the base plate and the mounting structure of the vehicle around a periphery of the base plate.

25. The striker apparatus of claim 20, wherein the radius of curvature of the base plate in cooperation with flexure of the base plate as the at least one fastener is tightened during installation improves stability and consumer satisfaction of the striker by reducing vibration and noise generated between the base plate and the mounting structure of the vehicle.

26. The striker apparatus of claim 20, wherein the inner surface and the mounting surface are mated at least at the distal ends of the curve and at least one fastening point.

27. The striker apparatus of claim 20, wherein a first end of the striker attaches to a first end portion of the base plate, and a second end of the striker attaches to a second end portion of the base plate.

28. The striker apparatus of claim 27, wherein the at least one fastener is positioned between the first and second ends of the striker.

29. The striker apparatus of claim 27, wherein the curved surface extends between the first and second ends of the striker.

30. The striker apparatus of claim 20, wherein the base plate and striker are unitarily formed.

31. The striker apparatus of claim 20, wherein the first point, the second point, and the at least one point along the concave profile are arranged along a line adjacent to a lateral edge of the base plate.

32. The striker apparatus of claim 20, wherein the at least one fastener extends through the base plate at the at least one point along the concave profile to flex the base plate from the pre-installation position to the post-installation position.

33. The striker apparatus of claim 32, wherein the generally mating mounting surface shape substantially conforms to the geometry of the support structure of the vehicle.

34. The striker apparatus of claim 20, wherein the at least one fastener engages the support structure to flex the base plate from the pre-installation position to the post installation position.

35. The striker apparatus of claim 20, wherein the concave profile extends continuously throughout the inner surface of the base plate.

* * * * *